US010021947B2

(12) United States Patent
Nakaya et al.

(10) Patent No.: US 10,021,947 B2
(45) Date of Patent: Jul. 17, 2018

(54) FASTENING TAPE WITH IMPROVED ATTACHMENT SYSTEMS

(71) Applicant: YKK CORPORATION OF AMERICA, Marietta, GA (US)

(72) Inventors: Atsushi Nakaya, Macon, GA (US); Zhiyu Ren, Macon, GA (US); Tsuyoshi Minato, Macon, GA (US); Wolfgang Coronel, Macon, GA (US); Keith Kratz, Hawkinsville, GA (US); Michael Fleming, Macon, GA (US)

(73) Assignee: YKK Corporation (JP)

( * ) Notice: Subject to any disclaimer, the term of this patent is extended or adjusted under 35 U.S.C. 154(b) by 261 days.

(21) Appl. No.: 15/055,504

(22) Filed: Feb. 26, 2016

(65) Prior Publication Data

US 2017/0245602 A1 Aug. 31, 2017

(51) Int. Cl.
*A44B 18/00* (2006.01)

(52) U.S. Cl.
CPC ..... *A44B 18/0073* (2013.01); *A44B 18/0069* (2013.01); *A44B 18/0076* (2013.01)

(58) Field of Classification Search
CPC ..... A44B 18/0073; A44B 18/0076; A44B 18/0069
See application file for complete search history.

(56) References Cited

U.S. PATENT DOCUMENTS 4,693,921 A * 9/1987 Billarant ..... A44B 18/0076 24/306
5,945,193 A * 8/1999 Pollard ..... A44B 18/0076 24/306
6,174,476 B1 * 1/2001 Kennedy ..... A44B 18/0003 264/167
6,463,635 B2 * 10/2002 Murasaki ..... A44B 18/0076 24/306

(Continued)

FOREIGN PATENT DOCUMENTS

JP 06038811 2/1994
JP 2000516482 12/2000

(Continued)

OTHER PUBLICATIONS

International Search Report, PCT Application No. PCT/JP2017/006944, dated May 16, 2017.

(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

Described is a fastening tape that includes improved attachment systems. To increase the effectiveness of attaching the fastening tape to a component foam, the bottom or underside of the fastening tape includes one or more membranes. The one or more membranes are attached to the bottom surface of the fastening tape at one or more attachment portions. To strengthen the attachment between the fastening tape and the (Continued)

component foam, the membrane may include one or more non-attachment portions in the form of open spaces or pockets into which the component foam may flow when introduced into the mold.

27 Claims, 11 Drawing Sheets

(56) References Cited

U.S. PATENT DOCUMENTS

| | | | | |
|---|---|---|---|---|
| 6,596,371 | B1 * | 7/2003 | Billarant | A44B 18/0076 24/442 |
| 8,425,998 | B2 * | 4/2013 | Poulakis | A44B 18/0073 24/304 |
| 8,512,845 | B2 * | 8/2013 | Terada | A44B 18/0049 428/100 |
| 2017/0265603 | A1 * | 9/2017 | Ronsen | A44B 18/0073 |

FOREIGN PATENT DOCUMENTS

| | | |
|---|---|---|
| JP | 2002078512 | 3/2002 |
| KR | 101372471 | 3/2014 |
| WO | 2013156368 | 10/2013 |

OTHER PUBLICATIONS

Written Opinion, PCT Application No. PCT/JP2017/006944, dated May 16, 2017.

* cited by examiner

FASTENING TAPE WITH IMPROVED ATTACHMENT SYSTEMS

FIELD OF THE INVENTION

This invention relates to hook and/or loop fastening tape that includes one or more features for increasing attachment strength and effectiveness between the fastening tape and component foam.

BACKGROUND

Numerous devices utilize fastening tape that includes hooks and/or loops. For example, in the automotive and other similar industries, fastening tape may be installed on a seat cushion or other component by first placing the fastener tape in a cavity or on a protrusion within a mold chamber. After the fastening tape has been so situated, component foam (such as urethane foam) is introduced into the mold chamber, which forms the seat cushion or other component around the fastening tape. The bottom or underside of the fastening tape attaches to the component foam to secure the fastening tape in position while leaving the hooks and/or loops exposed for engagement.

In certain situations, it may be desirable to increase the strength and effectiveness of the attachment between the fastening tape and the component foam to prevent failure of the fastening tape.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Versions of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain cases, a fastening tape comprises: at least one membrane disposed adjacent to a bottom of the fastening tape; at least one attachment portion connecting the at least one membrane with the bottom of the fastening tape; and at least two non-attachment portions between the at least one membrane and the fastening tape, wherein each of the at least two non-attachment portions are disposed adjacent to the at least one attachment portion. Each of the at least two non-attachment portions may form an open space between the at least one membrane and the bottom of the fastening tape.

According to certain cases, a fastening tape comprises: at least one nonwoven flexible membrane disposed adjacent to a bottom of the fastening tape; a plurality of attachment portions connecting the at least one nonwoven flexible membrane to the bottom of the fastening tape; a plurality of non-attachment portions that each form an open space between the at least one nonwoven flexible membrane and the bottom of the fastening tape. Each of the plurality of non-attachment portions may be disposed adjacent to or between the plurality of attachment portions, and the plurality of attachment portions together make up less than approximately 50% of an area of the bottom of the fastening tape.

According to certain cases, a fastening tape comprises: at least one nonwoven flexible fabric layer disposed adjacent to a bottom of the fastening tape; a plurality of attachment portions connecting the at least one nonwoven flexible fabric layer to the bottom of the fastening tape; a plurality of non-attachment portions that each form an open space between the at least one nonwoven flexible fabric layer and the bottom of the fastening tape. Each of the plurality of non-attachment portions are disposed adjacent to or between the plurality of attachment portions, and at least one of the plurality of non-attachment portions is a cantilevered area adjacent a lateral edge of the at least one nonwoven flexible fabric layer, wherein the lateral edge is a cantilevered portion that is not attached to the bottom of the fastening tape.

BRIEF DESCRIPTION OF THE DRAWINGS

Illustrative embodiments of the present disclosure are described in detail below with reference to the following drawing figures.

DETAILED DESCRIPTION

The subject matter of versions of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIGS. 1A-11 depict non-limiting examples of fastening tape. Although different reference numbers are used in various drawings, any of the features shown or described in relation to any of the drawings may be included, combined, substituted, or omitted to provide additional examples.

Figure 10A:
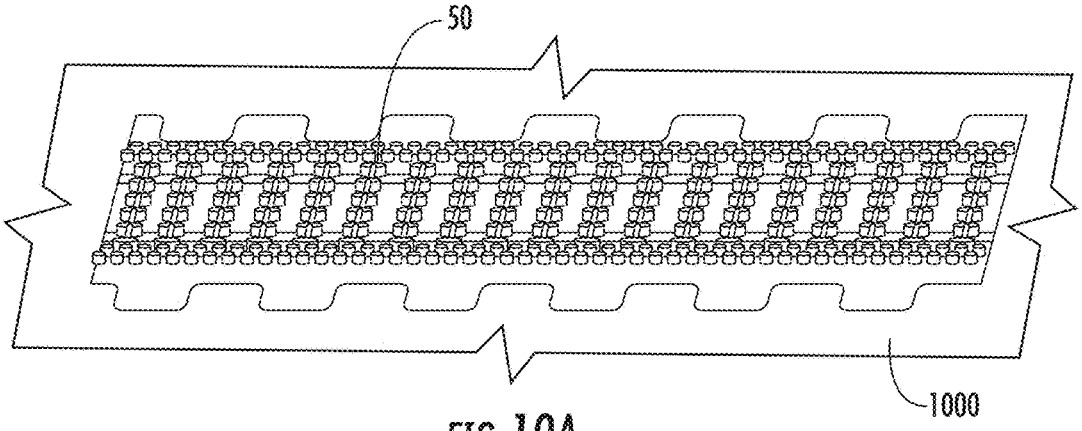
FIGS. 10A and 10B are perspective views of fastening tape according to certain aspects.
Figure 10B:
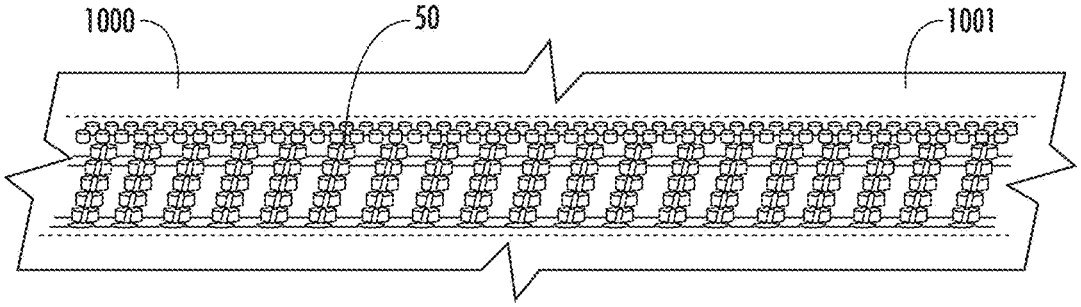

Disclosed are various non-limiting examples of fastening tape coupled with a membrane in a way that increases the strength of attachment between the fastening tape and component foam in which the fastening tape is embedded. In some examples, as shown in FIGS. 10A and 10B, the fastening tape (150, 250, 350, 450, 550, 650, 750, 850, 950) includes a plurality of hooks and/or loops 50. Lateral edges (102, 202, 302, 402, 502, 602, 702, 802, 902) of the fastening tape may include outer tabs (103, 203, 303, 403, 503, 603, 703, 803, 903) or may be generally straight without outer tabs.

Generally, when embedding fastening tape within component foam, the fastening tape is inverted so its bottom surface is exposed and the tape is placed top-side down in a mold chamber. Component foam is then introduced as a liquid or gelatinous substance into the mold chamber. The component foam cures such that the bottom of the fastening tape is embedded within a cured component foam structure 1000. As illustrated in FIG. 10B, the fastening tape may be recessed within the foam structure 1000 such that the upper surface of the fastening tape is approximately flush with the upper surface 1001 of the foam structure 1000 and the outer tabs (103, 203, 303, 403, 503, 603, 703, 803, 903) are buried within the foam structure 1000. The foam structure 1000 can attach to other components via the exposed hooks and/or loops 50. However, the strength of attachment of the other components to the hooks and/or loops 50 of the foam structure 1000 is dependent on the fastening tape remaining attached to the component foam structure 1000. Some existing designs have relied on direct attachment between the fastening tape and the component foam, which is not a particularly reliable interface.

FIGS. 1A-9C illustrate non-limiting examples of fastening tape (150, 250, 350, 450, 550, 650, 750, 850, 950) for use with improved attachment systems. To increase the effectiveness of attaching the fastening tape to the component foam, the bottom or underside of the fastening tape includes one or more membranes (101, 201, 301, 401, 501, 601, 701, 801, 901). The one or more membranes (101, 201, 301, 401, 501, 601, 701, 801, 901) may be constructed using any suitable material including, for example, woven materials, knit materials, fabric, mesh or net material, nonwoven material, flexible nonwoven fabric, entwined fiber sheet, entwined fiber on plastic film, or any other suitable material. In some examples, the one or more membranes cover or substantially cover the entire bottom surface of the fastening tape.

The one or more membranes are attached to the bottom surface of the fastening tape at one or more attachment portions (120, 220, 320, 420, 520, 620, 720, 820, 920) before the fastening tape is inserted into the mold for embedding within the component foam. Although the attachment portions are shown as straight lines in various directions (FIGS. 1A-6C and 8A-9C) or as discrete areas with regular shapes (FIGS. 7A-7C), the attachment portions may be curved, wavy, jagged, or any other appropriate type of line or shape. The one or more attachment portions may be attached to the fastening tape by one or more of direct lamination, heat lamination, ultrasonic lamination, chemical bonding, physical bonding, welding, pressing, gluing (or other chemical fasteners), or any other appropriate manner of attachment.

As explained in more detail below, to promote further attachment between the fastening tape and the component foam, the membrane may include one or more non-attachment portions (104, 105, 204, 205, 305, 404, 504, 604, 705, 707, 805, 904) in the form of open spaces or pockets into which the component foam may flow when introduced into the mold. In some cases, the non-attachment portions are arranged such that component foam is permitted to flow into the non-attachment portions from the lateral edges and/or ends of the fastening tape; in other cases, some or all of the non-attachment portions are not accessible from the perimeter of the fastening tape. In some cases, the membrane is sufficiently porous for the component foam (in liquid or gelatinous form) to penetrate partially or fully through the membrane and enter the open space or pocket. The component foam curing inside the non-attachment portions increases the strength of the attachment between the component foam and the fastening tape.

In some cases, the fastening tape and membrane are coupled such that the attachment portions cover less than approximately 50% of the surface area of the bottom surface of the fastening tape (i.e., the attachment between the membrane and the fastening tape accounts for less than approximately 50% of the bottom surface of the fastening tape). The attachment between the membrane and the component foam is more effective in non-attachment portions where the membrane is not attached to the fastening tape, as the attachment portions are less effective for attaching to the component foam because the membrane is modified at the attachment portions. In some cases, the membrane is distorted due to heat, pressure, or another reason. In some cases, the membrane may be saturated by glue or another adhesive, thus negatively impacting the strength of attachment of the membrane/fastening tape structure within the component foam along the attachment portions.

The one or more membranes as configured with non-attachment portions (i.e., all areas other than the attachment portions) provide stronger and more reliable attachment to the component foam. The one or more membranes provide a stronger and more effective attachment to the component foam due to one or more of (1) the membrane's surface properties (e.g., porosity, absorbency, open spaces between fibers, etc.), (2) the unattached portions of the membranes including open spaces or pockets formed between the membrane and the fastening tape (such that the component foam flows into the open spaces/pockets before curing), (3) the flexibility of the membrane, or (4) any other appropriate factor.

The non-attachment portions may have any suitable configuration and may be arranged in any suitable way along the one or more membranes. Several non-limiting examples are illustrated in the Figures and discussed below.

Figure 1A:
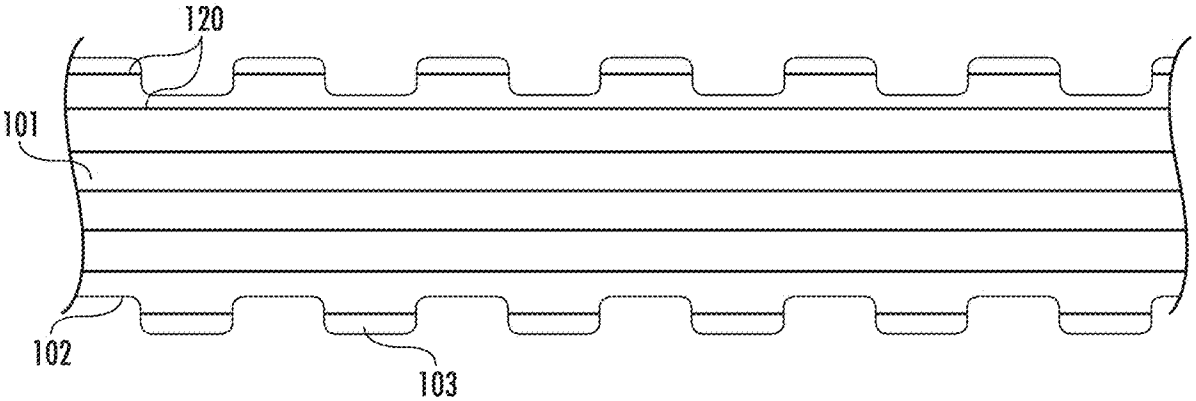
FIG. 1A is a bottom view of a portion of fastening tape according to certain aspects.

As shown in FIGS. 1A-3C, 6A-6C, and 8A-8C, one or more attachment portions (120, 220, 320, 620, 820) may extend along the fastening tape approximately parallel to the longitudinal direction of the fastening tape. Fastening tape 150 includes a plurality of longitudinal attachment portions 120. As illustrated in FIG. 1A, on one or both lateral edges of the fastening tape, the outer-most attachment portion 120 is disposed on the outer tabs 103. As set forth above, the membrane 101 is attached to the fastening tape 150 at the attachment portions 120. The membrane also includes non-attachment portions (104, 105) where excess material gathers between adjacent attachment portions 120 into open spaces or pockets 104 between the membrane 101 and the fastening tape 150. In addition, the non-attachment portions include one or more cantilevered areas 105 adjacent to a cantilevered portion 106.

Figure 1B:
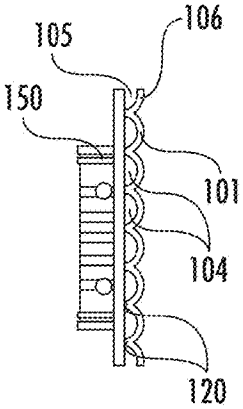
FIG. 1B is an end view of the fastening tape of FIG. 1A.
Figure 1C:
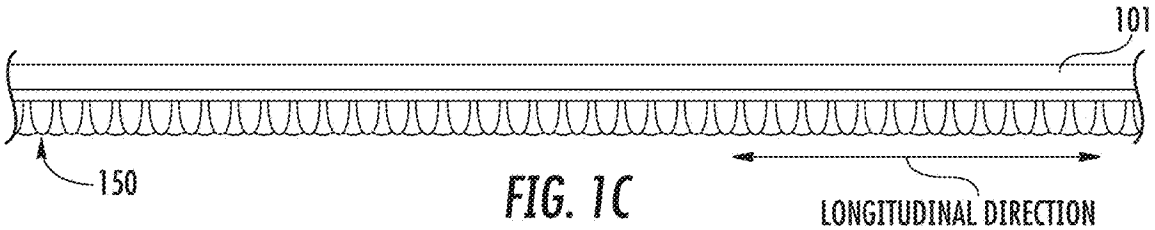
FIG. 1C is a side view of the fastening tape of FIG. 1A.

As shown in the end view in FIG. 1B, the outer edges of the membrane 101 include a non-attachment portion in the form of a cantilevered area 105 adjacent a cantilevered portion 106 of the membrane 101. Cantilevered area 105 is an open space or pocket formed at a lateral edge 102 of the fastening tape 150. The cantilevered portion 106 is a lateral edge of the membrane 101 that is unconnected to the bottom surface of fastening tape 150.

The component foam may flow in or around the cantilevered area 105 adjacent the cantilevered portion 106 of the membrane 101 during the molding process. Moreover, during the molding process, the component foam may flow into the non-attachment portions 104 from an end of the fastening tape and/or by penetrating through the membrane 101.

Figure 2A:
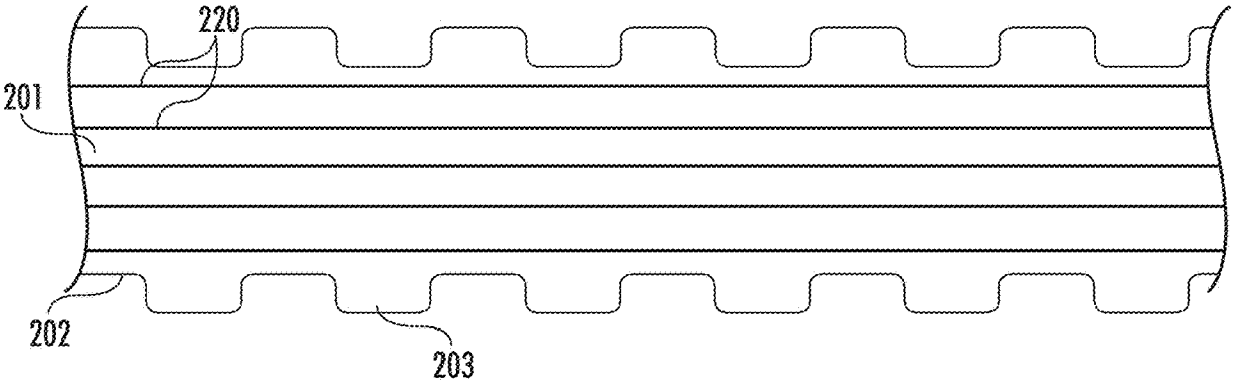
FIG. 2A is a bottom view of a portion of fastening tape according to certain aspects.
Figure 2B:
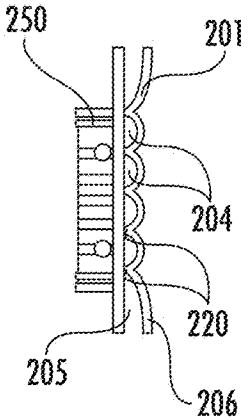
FIG. 2B is an end view of the fastening tape of FIG. 2A.
Figure 2C:
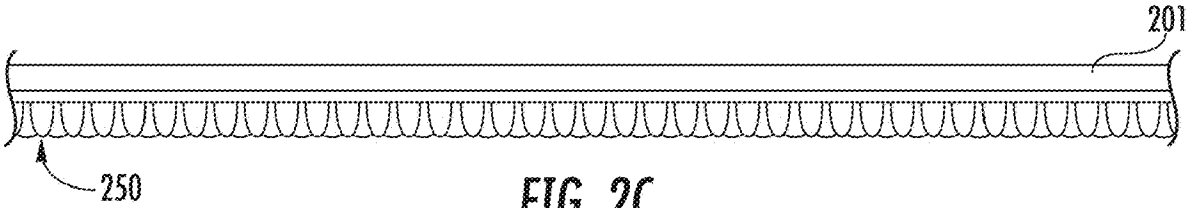
FIG. 2C is a side view of the fastening tape of FIG. 2A.

In some examples, as shown in FIGS. 2A-2C, the outermost attachment portions 220 are offset from the lateral edge 202 of the membrane 201 such that all of the attachment portions 220 are inboard of the lateral edge 202 of the fastening tape 250 and/or inboard of the outer tabs 203. As a result, the non-attachment portion (in the form of cantilevered portion 206) is larger, which increases the cantilevered area 205. For example, as shown in the end view in FIG. 2B, the cantilevered area 205 extends across the full width of the outer tab 203 and a portion of the fastening tape 250 inboard of the lateral edge 202. The larger cantilevered area 205 provides greater surface area for interfacing with the component foam during the molding process.

Figure 3A:
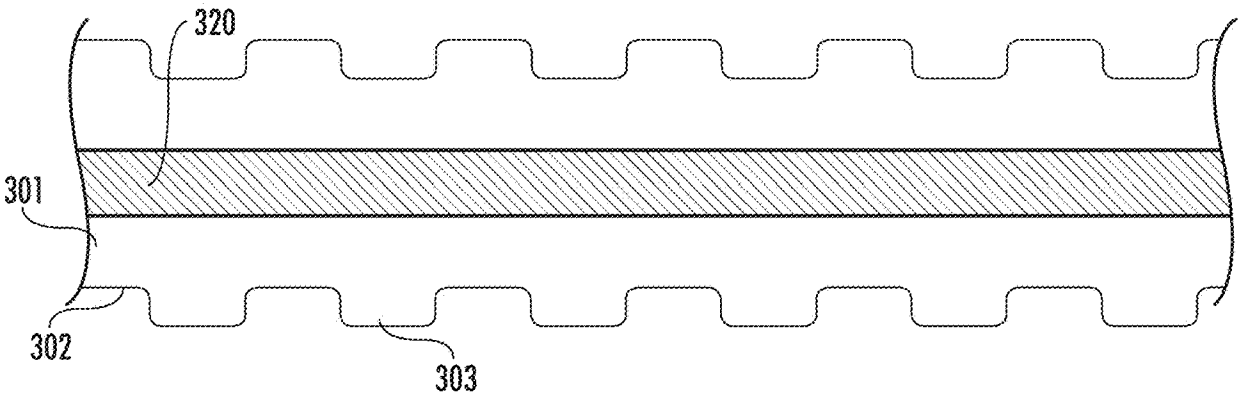
FIG. 3A is a bottom view of a portion of fastening tape according to certain aspects.
Figure 3B:
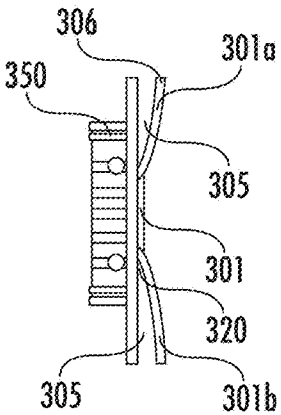
FIG. 3B is an end view of the fastening tape of FIG. 3A.
Figure 3C:
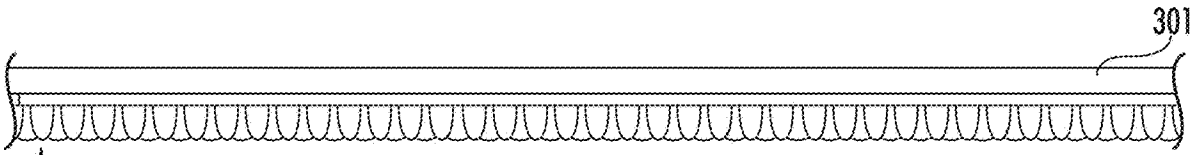
FIG. 3C is a side view of the fastening tape of FIG. 3A.

As shown in FIGS. 3A-3C, the attachment portion 320 where the membrane 301 is attached to the fastening tape 350 may be a single strip located approximately at a center of the width of the fastening tape 350 and extending along a longitudinal direction of the fastening tape. In some cases, the width of the attachment portion 320 is approximately 20% of the overall width of the fastening tape 350, although the attachment portion 320 may be any appropriate width relative to the fastening tape 350 including, for example, approximately 5%, 10%, 30%, 40%, 50%, or any other appropriate amount. Due to the arrangement of the attachment portion 320, the non-attachment portion (in the form of cantilevered area 305) is larger than cantilevered areas 105 and 205. For example, as shown in the end view in FIG. 3B, each cantilevered portion 306 adjacent the cantilevered area 305 extends across approximately 30-40% of the overall width of the fastening tape 350. Each cantilevered area 305 may be any appropriate width relative to the fastening tape 350 including, for example, 47.5%, 45%, 35%, 30%, 25%, or any other appropriate amount, and its width can be adjusted by adjusting the positioning of the attachment portion 320. When the component foam is introduced during the molding process, the foam is permitted to flow adjacent to the cantilevered portion 306 and into the cantilevered area 305 to increase the attachment strength of the membrane to the fastening tape.

Figure 4A:
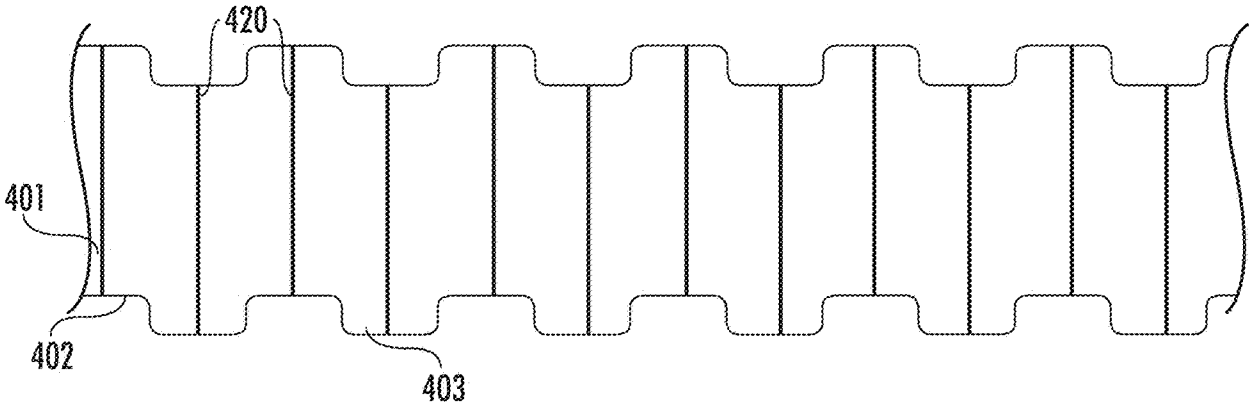
FIG. 4A is a bottom view of a portion of fastening tape according to certain aspects.

In some examples, as shown in FIGS. 4A-6C, the attachment portions 420 may extend approximately perpendicular and/or oblique with respect to the longitudinal direction of the fastening tape. For example, FIGS. 4A-4C illustrate attachment portions 420 that are approximately perpendicular to the longitudinal direction of the fastening tape 450. As shown in FIG. 4A, the attachment portions 420 may be spaced such that each outer tab 403 includes one attachment portion 420 that approximately bisects each outer tab 403. The attachment portions 420 may be arranged closer together or spaced farther apart. As shown in FIG. 4C, the non-attachment portions 404 are accessible from the lateral edges 402 of the fastening tape 450, thus allowing the component foam to flow into the non-attachment portions 404 and along the width of the fastening tape when the component foam is introduced.

Figure 5A:
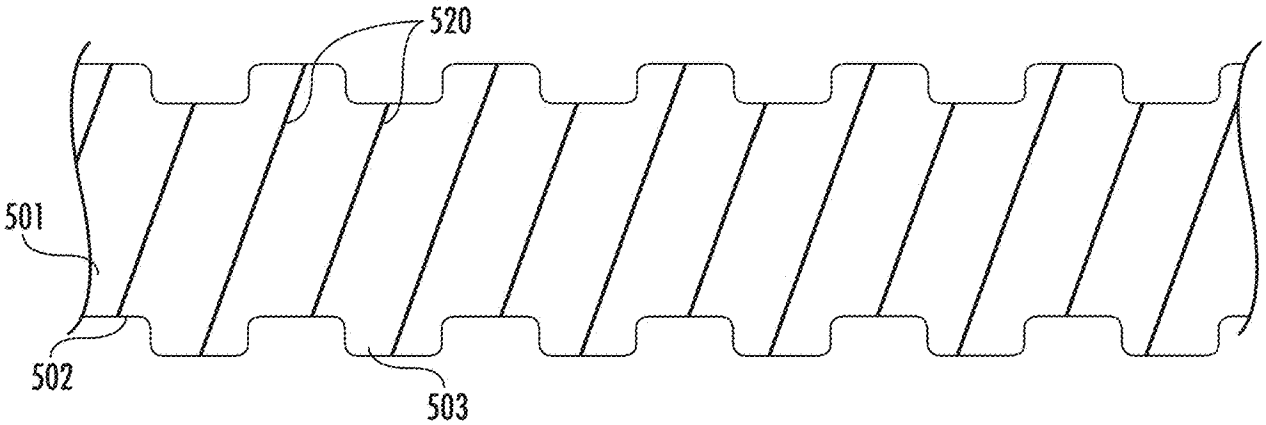
FIG. 5A is a bottom view of a portion of fastening tape according to certain aspects.
Figure 5B:
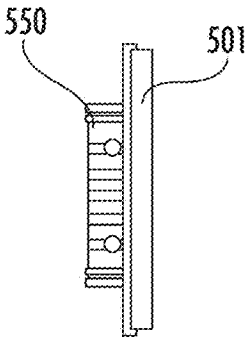
FIG. 5B is an end view of the fastening tape of FIG. 5A.
Figure 5C:
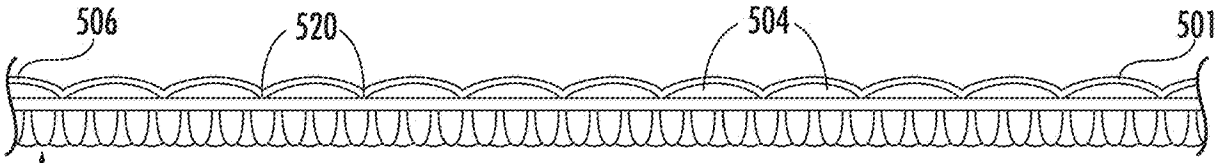
FIG. 5C is a side view of the fastening tape of FIG. 5A.

FIGS. 5A-5C show attachment portions 520 that are arranged so they are oblique with respect to the longitudinal direction of the fastening tape. For example, attachment portions 520 are oblique and oriented approximately 60° with respect to the longitudinal direction of the fastening tape 550. The attachment portions 520 may be arranged at any appropriate angle with respect to the longitudinal direction of the fastening tape 550, such as 15°, 30°, 45°, 75°, etc. As shown in FIG. 5C, the non-attachment portions 504 are accessible from the lateral edges 502 of the fastening tape 550, thus allowing the component foam to flow into the non-attachment portions 504 along a width and a longitudinal direction of the fastening tape when the component foam is introduced.

Figure 6A:
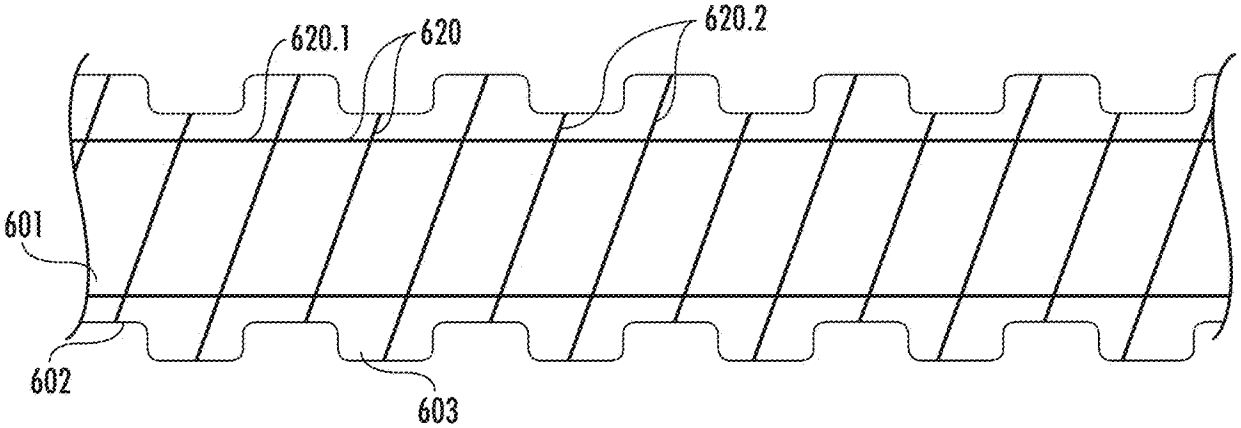
FIG. 6A is a bottom view of a portion of fastening tape according to certain aspects.
Figure 6B:
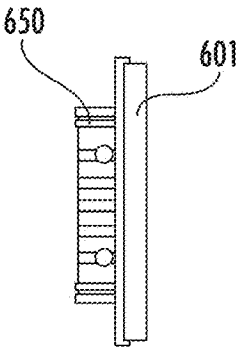
FIG. 6B is an end view of the fastening tape of FIG. 6A.
Figure 6C:
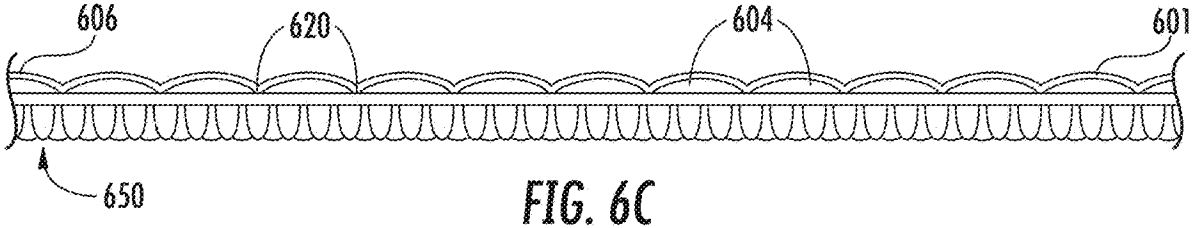
FIG. 6C is a side view of the fastening tape of FIG. 6A.

FIGS. 6A-6C show an example that includes (1) at least one first attachment portion 620.1 that is approximately parallel with respect to the longitudinal direction of the fastening tape 650 and (2) at least one second attachment portion 620.2 that is oblique with respect to the longitudinal direction of the fastening tape 650. Some of the non-attachment portions 604, such as the pockets or open spaces between the two first attachment portions 620.1 and between two adjacent second attachment portions 620.2 where the pocket is closed on all four sides, are not directly accessible from a perimeter of the fastening tape 650. However, as explained above, foam may penetrate the non-attachment portions 604 through the membrane 601.

Figure 7A:
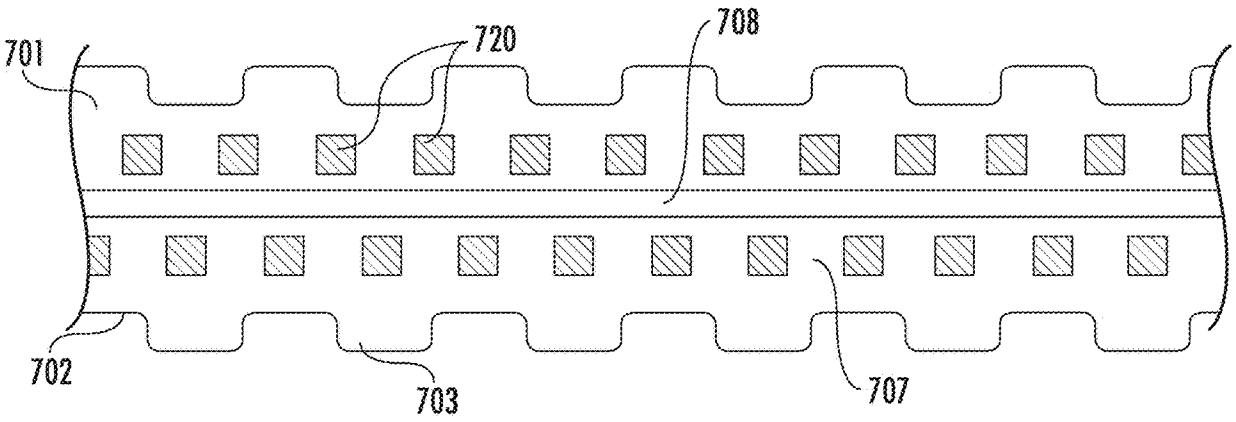
FIG. 7A is a bottom view of a portion of fastening tape according to certain aspects.
Figure 7B:
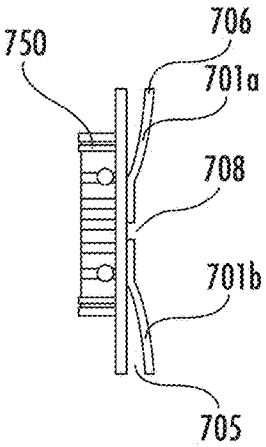
FIG. 7B is an end view of the fastening tape of FIG. 7A.
Figure 7C:
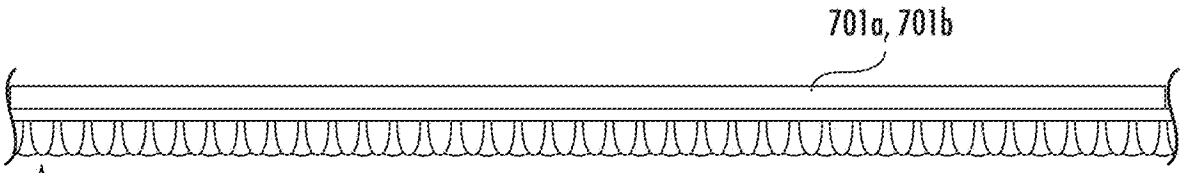
FIG. 7C is a side view of the fastening tape of FIG. 7A.

As shown in FIGS. 7A-7C, in some examples, the attachment portions 720 may be a plurality of discrete areas that are unconnected with one another. FIG. 7A shows multiple attachment portions 720 that each have the same square shape. However, the attachment portions 720 may be different from one another and may be any suitable shape (such as, but not limited to, circles, ovals, triangles, diamonds, polygons, etc.) and be any appropriate size.

FIGS. 7A-9C show examples with multiple membranes. For example, as shown in FIG. 7B, fastening tape 750 includes a first membrane 701*a* and a second membrane 701*b* with a gap 708 between the membranes. As shown in FIG. 8B, fastening tape 850 includes a first membrane 801*a* and a second membrane 801*b* with a gap 808 between the membranes. As shown in FIG. 9B, fastening tape 950 includes a first membrane 901*a* and a second membrane 901*b* with a gap 908 between the membranes. Although these examples each include two membranes with an open space or gap where the fastening tape is not covered by a membrane, the fastening tape may include any number of membranes with any number of open spaces/gaps where the fastening tape is not covered by a membrane. Foam is permitted to flow into the gaps 708, 808, 908 between the membranes. Alternatively, the entire surface of the fastening tape may be covered by multiple membranes without any gaps. In some cases, multiple membranes (two or more) may overlap one another.

As shown in FIGS. 7A-7C, membrane 701 includes membranes 701*a* and 701*b*, each of which include a series of discrete attachment portions 720 arranged in a line, where the attachment portions of the second membrane 701*b* are adjacent the attachment portions of the first membrane 701*a*. The attachment portions of the second membrane 701*b* are shown offset with respect to the attachment portions of the first membrane 701*a*, although this is not required, and, in some cases, the attachment portions of the two membranes may be aligned. The attachment members 720 may be arranged in other patterns and need not be arranged in a straight line. The membrane 701 also includes non-attachment portions (705, 707) where excess material gathers between adjacent attachment portions 720 into open spaces or pockets 707 between the membrane 701 and the fastening tape 750. In addition, the non-attachment portions include one or more cantilevered areas 705 adjacent to a cantilevered portion 706. The non-attachment portions 707 are disposed between the attachment portions 720 such that the component foam can enter the non-attachment portion 707 from the lateral edges 702 or the ends of the fastening tape.

Figure 8A:
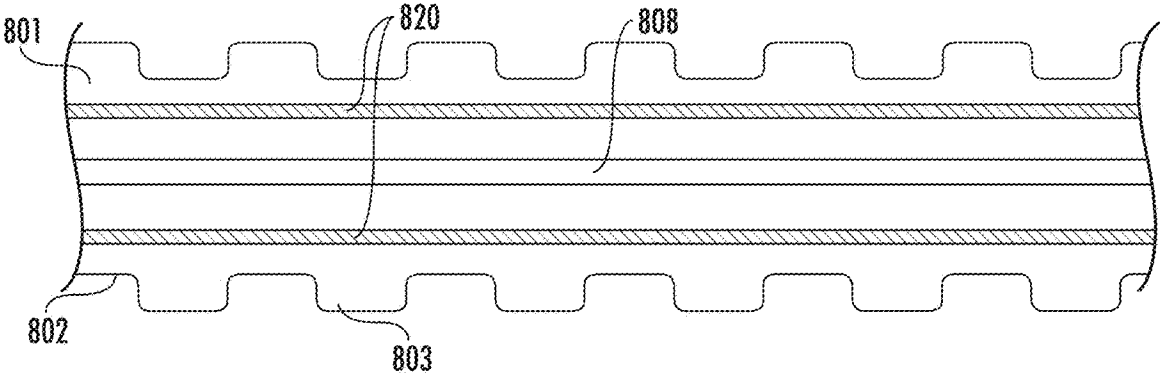
FIG. 8A is a bottom view of a portion of fastening tape according to certain aspects.
Figure 8B:
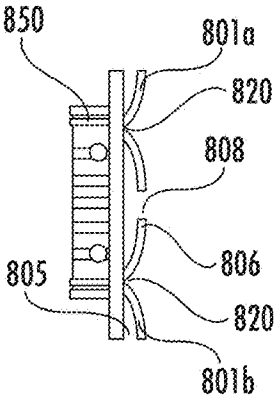
FIG. 8B is an end view of the fastening tape of FIG. 8A.
Figure 8C:
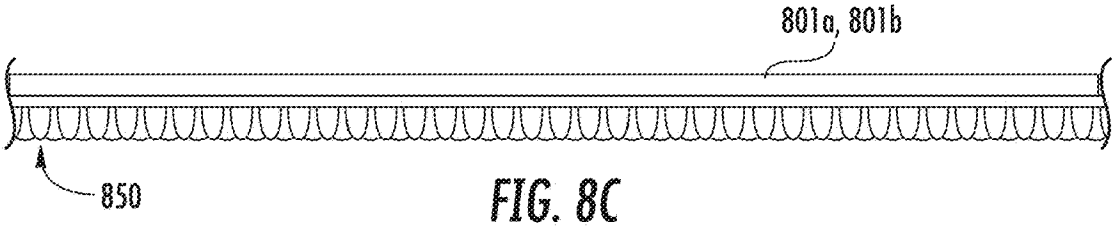
FIG. 8C is a side view of the fastening tape of FIG. 8A.

As shown in FIGS. 8A-8C, each membrane 801*a*, 801*b* includes a single longitudinal attachment portion 820 that extends along the longitudinal direction of the fastening tape. Accordingly, each membrane may include two cantilevered portions 806 and two cantilevered areas 805 into which foam is permitted to flow as described above. In particular, foam may enter the cantilevered areas 805 from the lateral edges 802 and ends of the fastening tape and from the gap 808.

Figure 4B:
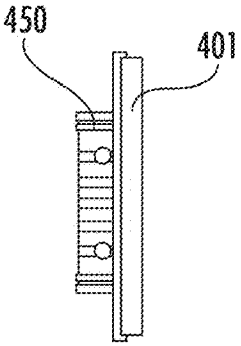
FIG. 4B is an end view of the fastening tape of FIG. 4A.
Figure 4C:
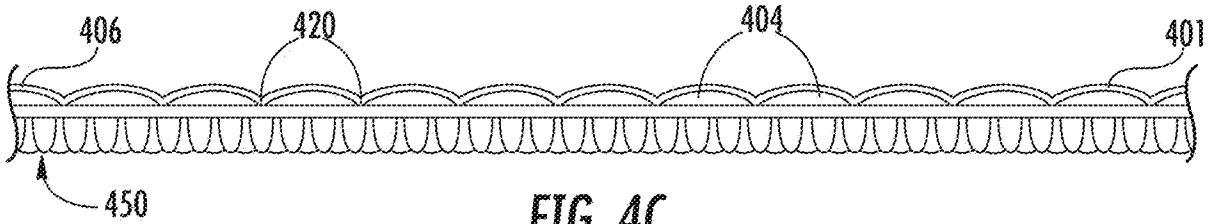
FIG. 4C is a side view of the fastening tape of FIG. 4A.
Figure 9A:
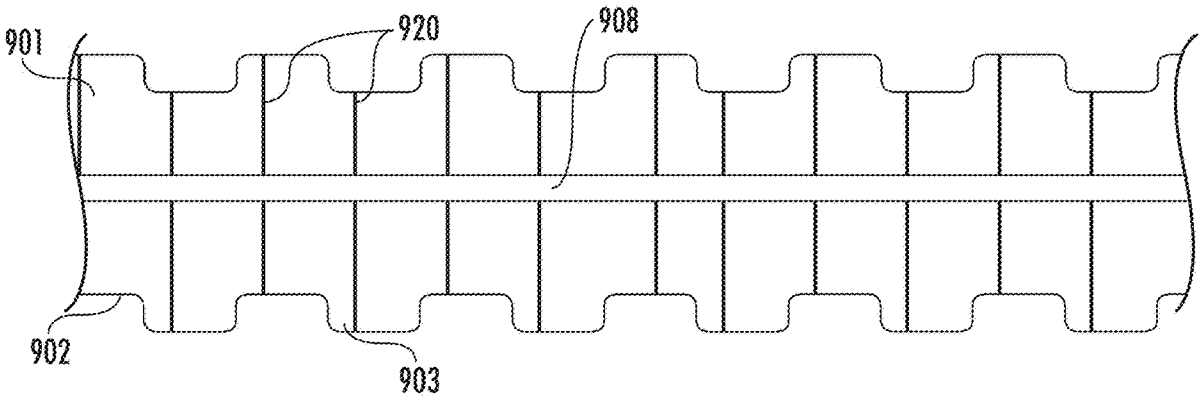
FIG. 9A is a bottom view of a portion of fastening tape according to certain aspects.
Figure 9B:
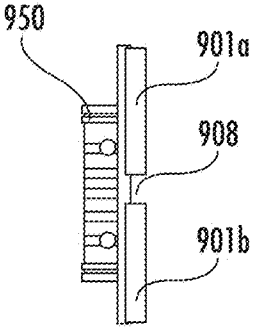
FIG. 9B is an end view of the fastening tape of FIG. 9A.
Figure 9C:
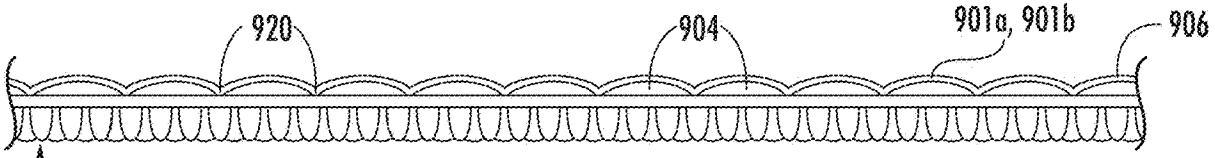
FIG. 9C is a side view of the fastening tape of FIG. 9A.

As shown in FIGS. 9A-9C and similar to FIGS. 4A-4C, the attachment portions 920 may extend approximately perpendicular with respect to the longitudinal direction of the fastening tape. For example, FIGS. 9A-9C illustrate attachment portions 920 that are approximately perpendicular to the longitudinal direction of the fastening tape 950. The attachment portions 920 may be arranged any appropriate distance apart. As shown in FIG. 9C, the non-attachment portions 904 are accessible from the lateral edges 902 of the fastening tape 950, thus allowing the component foam to flow into the non-attachment portions 904 and along the lateral edges 902 and along the gap 908 of the fastening tape when the component foam is introduced.

Figure 11:
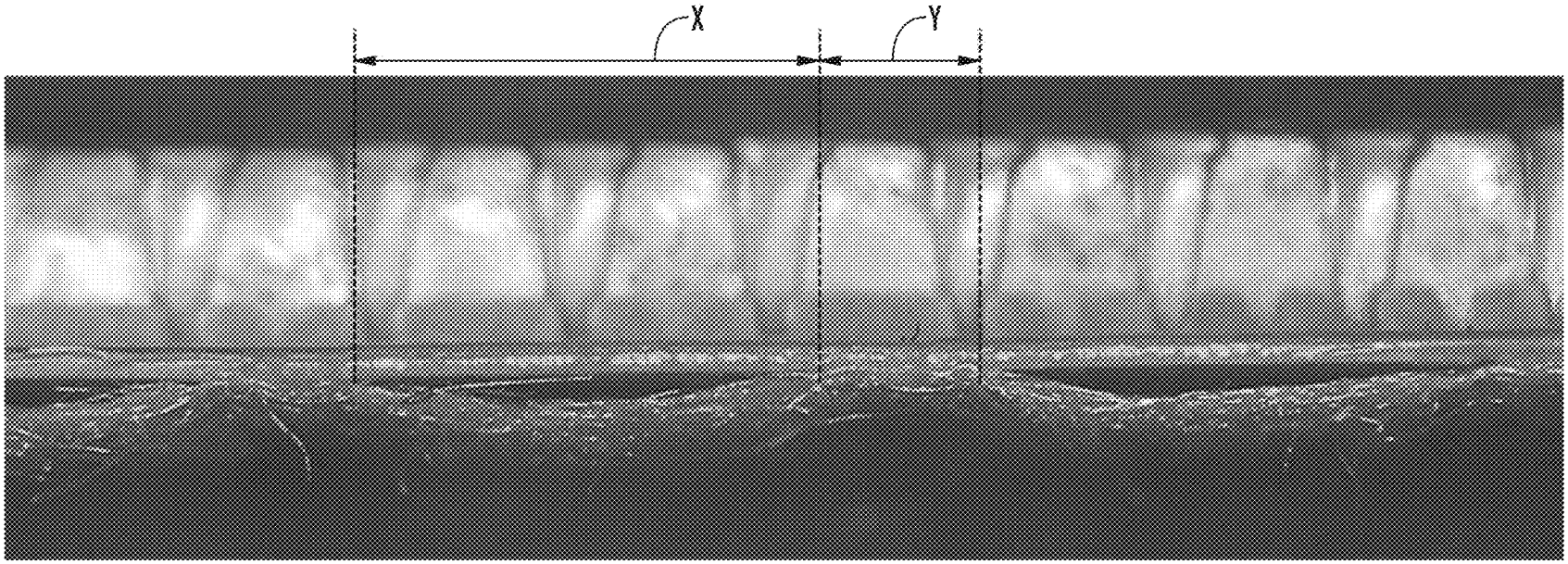
FIG. 11 is a magnified photograph of a portion of fastening tape according to certain aspects.

FIG. 11 shows a magnified view of an non-attachment portion and an attachment portion of a fastening tape and membrane structure. As illustrated, the length X of the non-attachment portion is greater than the length Y of the attachment portion. In some cases, the length X of the non-attachment portion is approximately four times greater than the length Y of the attachment portion (X=4Y). In some cases, Y is approximately 1 mm and X is approximately 4 mm, although X and Y may be any suitable length.

The components of the fastening tape may be formed of materials including, but not limited to, nylon, polypropylene, non-woven polypropylene, other plastic materials, thermoplastic, metallic materials, other composite materials, cotton, wool, synthetic fabric, or other similar materials. Moreover, the components of the fastening tape may be attached to one another via suitable fasteners, which include, but are not limited to, glue or any suitable adhesive, hook and loop fasteners, ultrasonic welding, other mechanical or chemical fasteners.

Different arrangements of the components depicted in the drawings or described above, as well as components and steps not shown or described are possible. Similarly, some features and sub-combinations are useful and may be employed without reference to other features and sub-combinations. Cases of the invention have been described for illustrative and not restrictive purposes, and alternative cases will become apparent to readers of this patent. Accordingly, the present invention is not limited to the cases described above or depicted in the drawings, and various cases and modifications may be made without departing from the scope of the claims below.

That which is claimed is:

1. A fastening tape comprising:

at least one membrane disposed adjacent to a bottom of the fastening tape;

at least one attachment portion connecting the at least one membrane with the bottom of the fastening tape; and at least two non-attachment portions between the at least one membrane and the fastening tape, wherein each of the at least two non-attachment portions are disposed adjacent to the at least one attachment portion and wherein each of the at least two non-attachment portions forms an open space between the at least one membrane and the bottom of the fastening tape.

2. The fastening tape of claim 1, wherein the at least one membrane covers substantially an entire surface of the bottom of the fastening tape.

3. The fastening tape of claim 1, wherein the at least one attachment portion extends in a longitudinal direction of the fastening tape.

4. The fastening tape of claim 3, wherein the at least one attachment portion comprises a plurality of attachment portions that are generally straight and parallel to one another.

5. The fastening tape of claim 3, wherein the at least one attachment portion comprises at least one attachment portion disposed on an outer tab of the fastening tape.

6. The fastening tape of claim 3, wherein the at least one attachment portion comprises an attachment portion disposed approximately at a center of the fastening tape.

7. The fastening tape of claim 6, wherein the at least one attachment portion extends across approximately 20% of an overall width of the fastening tape.

8. The fastening tape of claim 1, wherein the at least one attachment portion extends in a direction perpendicular to a longitudinal direction of the fastening tape.

9. The fastening tape of claim 1, wherein at least one of the at least two non-attachment portions is a cantilevered area adjacent a lateral edge of the at least one membrane, wherein the lateral edge is a cantilevered portion that is not attached to the bottom of the fastening tape.

10. The fastening tape of claim 9, wherein the at least one membrane is a nonwoven fabric.

11. The fastening tape of claim 1, wherein the at least one attachment portion extends in a direction oblique to a longitudinal direction of the fastening tape.

12. The fastening tape of claim 1, wherein the at least one attachment portion comprises a plurality of discrete shapes that are separated from one another.

13. The fastening tape of claim 1, wherein the at least one membrane comprises two membranes.

14. The fastening tape of claim 13, wherein the two membranes are separated from one another by a gap.

15. A fastening tape comprising:

at least one nonwoven flexible membrane disposed adjacent to a bottom of the fastening tape;

a plurality of attachment portions connecting the at least one nonwoven flexible membrane to the bottom of the fastening tape;

a plurality of non-attachment portions that each form an open space between the at least one nonwoven flexible membrane and the bottom of the fastening tape, wherein each of the plurality of non-attachment portions are disposed adjacent to or between the plurality of attachment portions; and wherein the plurality of attachment portions together make up less than approximately 50% of an area of the bottom of the fastening tape.

16. The fastening tape of claim 15, wherein the at least one nonwoven flexible membrane is a single membrane that substantially covers an entire surface of the bottom of the fastening tape.

17. The fastening tape of claim 15, wherein at least some of the plurality of attachment portions extend parallel to one another and parallel to a longitudinal direction of the fastening tape.

18. The fastening tape of claim 17, wherein each of the plurality of attachment portions are disposed inboard of a lateral edge of the fastening tape and inboard of an outer tab of the fastening tape.

19. The fastening tape of claim 15, wherein at least some of the plurality of attachment portions extend in a direction parallel to a longitudinal direction of the fastening tape and at least some of the plurality of attachment portions extend in a direction oblique to the longitudinal direction of the fastening tape.

20. The fastening tape of claim 15, wherein at least some of the plurality of attachment portions extend in a direction perpendicular to a longitudinal direction of the fastening tape.

21. The fastening tape of claim 20, wherein at least some of the plurality of attachment portions approximately bisect a corresponding outer tab.

22. The fastening tape of claim 15, wherein at least some of the plurality of attachment portions extend in a direction oblique to a longitudinal direction of the fastening tape.

23. The fastening tape of claim 15, wherein at least some of the plurality of attachment portions comprise a plurality of discrete shapes that are separated from one another.

24. The fastening tape of claim 15, wherein the at least one nonwoven flexible membrane comprises two membranes disposed adjacent one another along a width of the fastening tape.

25. The fastening tape of claim 15, wherein at least one of the plurality of non-attachment portions is a cantilevered area adjacent a lateral edge of the at least one nonwoven flexible membrane, wherein the lateral edge is a cantilevered portion that is not attached to the bottom of the fastening tape.

26. A fastening tape comprising:

at least one nonwoven flexible fabric layer disposed adjacent to a bottom of the fastening tape;

a plurality of attachment portions connecting the at least one nonwoven flexible fabric layer to the bottom of the fastening tape;

a plurality of non-attachment portions that each form an open space between the at least one nonwoven flexible fabric layer and the bottom of the fastening tape, wherein:

each of the plurality of non-attachment portions are disposed adjacent to or between the plurality of attachment portions; and at least one of the plurality of non-attachment portions is a cantilevered area adjacent a lateral edge of the at least one nonwoven flexible fabric layer, wherein the lateral edge is a cantilevered portion that is not attached to the bottom of the fastening tape.

27. The fastening tape of claim 26, wherein the plurality of attachment portions together account for less than approximately 50% of an area of the bottom of the fastening tape.

* * * * *